US005443019A

United States Patent [19]

Sheldrick

[11] Patent Number: 5,443,019

[45] Date of Patent: Aug. 22, 1995

[54] MECHANIC'S WORK TRAY

[76] Inventor: Garry R. Sheldrick, 1035 N. Batavia, Orange, Calif. 92667

[21] Appl. No.: 154,139

[22] Filed: Nov. 18, 1993

[51] Int. Cl.[6] ..... A47B 23/00
[52] U.S. Cl. ..... 108/44
[58] Field of Search ..... 108/44, 45, 46, 102, 108/137, 143

[56] References Cited

U.S. PATENT DOCUMENTS

| | | | |
|---|---|---|---|
| 1,723,238 | 8/1929 | Hoot . | |
| 1,888,736 | 11/1932 | Park | 108/44 X |
| 2,901,303 | 8/1959 | Anderson . | |
| 3,015,530 | 1/1962 | Anderson . | |
| 3,698,330 | 10/1972 | Krombach . | |
| 4,418,626 | 12/1983 | Semien | 108/49 X |
| 4,493,393 | 1/1985 | Serber . | |
| 4,713,949 | 12/1987 | Wilcox | 108/102 X |
| 4,811,875 | 3/1989 | DiSimone | 108/44 X |
| 4,911,083 | 3/1990 | Considine | 108/44 |
| 4,942,827 | 7/1990 | Norgaard | 108/44 |
| 5,331,904 | 7/1994 | DiSimone et al. | 108/44 |

FOREIGN PATENT DOCUMENTS

| | | | |
|---|---|---|---|
| 46663 | 12/1932 | Denmark | 108/44 |
| 4740 | of 1911 | United Kingdom | 108/137 |

*Primary Examiner*—Jose V. Chen
*Attorney, Agent, or Firm*—James G. O'Neill

[57] ABSTRACT

A mechanic's work tray for supporting a plurality of items to be used by the mechanic in and around an engine compartment. The work tray has an upper tray section with a pair of L-shaped legs adjustably mounted thereto for quick and easy insertion of and supporting of the tray over substantially any size engine compartment. The adjustable legs enable a single person to align and support the work tray over the air cleaner of an engine in substantially any vehicle, to allow quick and easy storage and use of tools and parts on the tray when working in the engine compartment. The work tray is assembled from a minimum of parts so as to include a pair of carrying handles integrally formed with the upper tray section and adjustable leg means secured to guiding and holding elements held between the upper tray section and the L-shaped legs, to allow for easy adjustability of the leg means and use of the work tray.

14 Claims, 1 Drawing Sheet

MECHANIC'S WORK TRAY

BACKGROUND OF THE INVENTION

1. Field of the Invention

This invention relates generally to a tray for supporting tools, parts and supplies, and more particularly, to an improved mechanic's tray for mounting in a vehicle, over the engine compartment in an accessible position, to facilitate repair of the vehicle in which it is so mounted.

2. Description of Related Art

It is well known that a mechanic or other person working on a vehicle in or around the engine compartment has need for a convenient area to place needed tools, parts and supplies so as to save labor and time in continuously reaching and/or searching for the same. Therefore, a number of devices having trays for supporting tools and supplies, or the body of mechanics in position adjacent the engine of an automobile, are known. These known devices include trays secured to and supported by the body of an automobile, in desired positions toward the front thereof, as illustrated in U.S Pat. Nos. 1,723,238, 2,901,303 and 3,015,530. Other known devices are supported by the engine or fenders of the vehicle and are designed to support the body of a mechanic to enable the mechanic to lean on or lie against the device adjacent to or over the engine compartment. Such body supporting devices are shown in U.S Pat. Nos. 3,698,330 ('330) and 4,493,393. These body supporting devices may also include separate tool carrying or support trays, removably attached thereto. Furthermore, the '330 body supporting device patent includes adjustable, telescoping legs pivotably mounted to the body supporting portion of the device. However, these pivotably mounted, telescoping legs are complex, not easy to use, are expensive to manufacture and maintain, and are not adaptable to be used on a tray for supporting tools and the like, mounted over a vehicle engine compartment.

Although the above-identified prior art patents solve some of the known problems encountered by mechanics when working around an engine compartment, under the hood of a vehicle, they do not solve all the known problems, such as attempting to use known holding trays for tools, parts and supplies, in various vehicles having different size engine compartments and/or engines, with or without hoods covering the same. Nor can such known tray devices be easily moved around or adjusted while under the hood of a vehicle. Therefore, there still exists the need for a simple, easy to use and low-cost mechanic's tool, part and supply support tray, that is both portable and easily adjusted so as to be mounted and securely supported in substantially any operative position, in various size and makes of vehicles, so as to allow a mechanic to easily and safely work on or around the engine compartment, of various vehicles, and which tray is also adjustable to take up a minimum of space when stored.

SUMMARY OF THE INVENTION

Accordingly, it is a general object of the present invention to provide an improved mechanic's under the hood work tray. It is a particular object of the present invention to provide a mechanic's under the hood work tray that is adaptable to fit over the engine compartment in substantially any vehicle. It is a still more particular object of the present invention to provide a mechanic's under the hood work tray which is both adjustable and strong enough to bridge the engine compartment of substantially any vehicle, for use by a mechanic to store tools and the like therein, when working on the vehicle. It is a further particular object of the present invention to provide an easy to manufacture and simple to use and store mechanic's work tray that includes adjustable leg means which are extensible so as to bridge the width of various vehicle engine compartments to allow the tray to be supported by the interior lip portions of opposite fenders of the vehicle, over the air cleaner of the vehicle engine.

In accordance with one aspect of the invention there is provided a work tray having a base with a pair of legs mounted thereto so as to be easily and quickly extensible from the tray base for ready insertion of and supporting of the tray over a vehicle engine compartment, in substantially any position bridging the same. The extensible legs portions enable a single mechanic to extend or retract the legs from either or both sides of the tray, without affecting the tray, so as to align and support the tray over an engine compartment of a vehicle, in substantially any position, to allow storage of and easy access to tools, parts and supplies held on the tray, when working in or around the engine compartment. Additionally, the tray is assembled from a minimum of parts so as to include a pair of carrying handles, a base and slidable leg means, to allow for easy adjustability and carrying of the tray, without the need of special tools or devices.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

Figure 1:
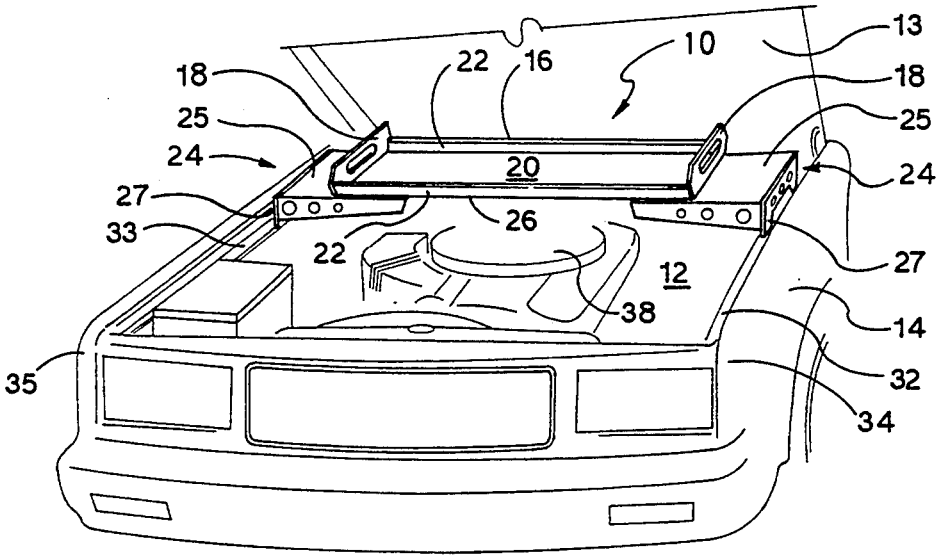
FIG. 1 is a perspective view, looking from the front of a vehicle, with a work tray in accordance with the present invention, suspended over the engine compartment, under the hood, of a vehicle, with the legs of the tray supported in lip portions of opposite fenders of the vehicle.
Figure 2:
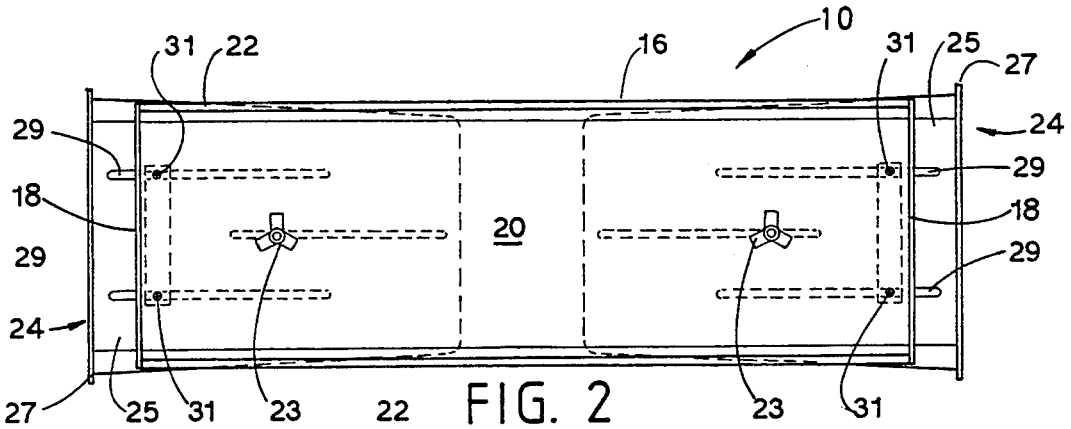
FIG. 2 is a top plan view of the work tray of the present invention, with the adjustable leg portions thereof in a withdrawn position for storage or carrying.
Figure 3:
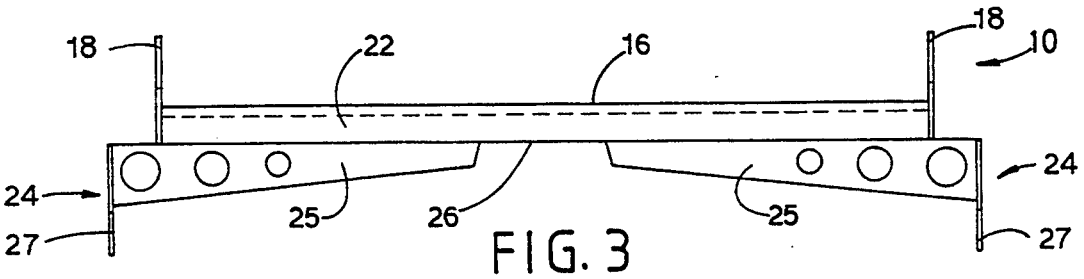
FIG. 3 is a front elevational view of the work tray of FIG. 2.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved mechanic's holding or work tray 10 for use around and over an engine compartment 12, under a hood 13, of a vehicle, part of which is shown generally at 14.

The improved work tray 10 includes an upper section 16, which preferably forms a single piece, substantially rectangular holding tray or supporting platform, having a pair of handles 18, formed integrally with, or fixed to a flat base or platform portion 20, in any convenient manner known to those skilled in the art. The base or platform 20 is preferably formed so as to be substantially flat and rectangular, and is strong and solid enough to support tools, parts, supplies and the like therein between the handles 18 and further raised side edges or walls 22. The platform 20 may also include internal partitioning means, such as dividing walls or compartments (not shown) so as to form separate areas for holding various-tools, parts or supplies. It is to be understood that the handles 18 are integral with end walls at opposite ends of the base 20, and that these end walls and the side walls 22 may be formed or fixed to the platform 20 at any convenient angle, in any known manner, to form the completed upper section 16. That is, the platform, end walls and handles, and side walls form a supporting tray section 16 that is made from a metal, plastic, or other types of sturdy material that have sufficient weight and strength that this tray section 16 may be safely used around vehicles to support various heavy items therein. Furthermore, all of the parts of work tray 10 should be formed from a material which is itself substantially resistant to, or is provided with a coating that is substantially resistant to, abuse by tools and supplies thrown or stored therein, and/or materials, such as gasoline and oils used in and around a vehicle engine compartment, which may fall or splash on the work tray. Furthermore, this material or coating should be capable of being easily cleaned or wiped-off so that the work tray 10 may be used again on other vehicles, or stored. Additionally, the material from which the upper tray section 16 and extensible leg means 24 (described below) are made, must be of adequate thickness and have sufficient strength so that the platform 20 and/or leg means 24 will adequately carry, and not be bent or buckled by heavy tools, parts or supplies supported therein.

Figure 6:
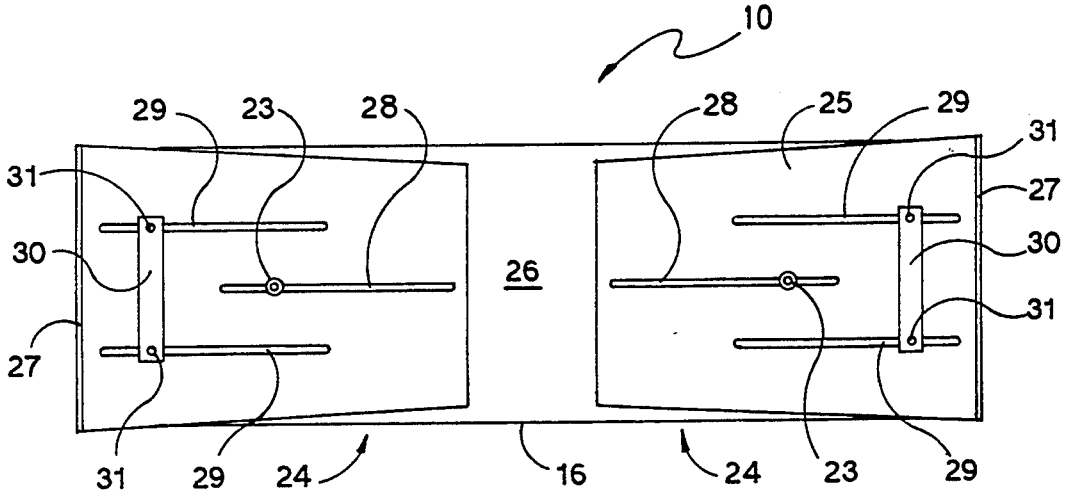
FIGS. 6 is a bottom plan view of the work tray of FIG. 2.

The substantially flat platform 20 includes a pair of adjustable fixing or securing means 23, such as wingnut and bolt means attached thereto so as to pass through a pair of aligned openings formed in the platform (not shown). These adjustable fixing means 23 also pass through and are held in elongated openings or slot means 28, formed in an upper or elongated portion of a pair of L-shaped, extensible leg means 24 (as shown more clearly in FIG. 6). That is, the fixing means 23 extend through the holes (not shown) of platform 20 so as to extend from a bottom or parallel, underlying surface 26 of the platform, and are slidably captured in the slots 28 formed in the elongated upper portions 25 of the leg means 24. A further plurality of openings 29, such as the pair of openings shown in FIG. 6, are also formed, in any convenient manner, in the upper portions 25 of the L-shaped leg means, and capture therein further holding and guide means 30, fixedly attached to securing means, such as pins 31, held to the platform 20, in such a manner as to allow the adjustable leg means 24 to be separately or simultaneously moved along a guided path, with respect to the upper tray section 16.

The work tray 10 is held and supported over various engine compartments, such as 12, by means of a pair of downwardly extending support legs or portions 27, fixed to or formed integrally with the elongated upper portions 25 of each of the L-shaped leg means 24. The L-shaped leg means 24 may also include bracing or strengthening side elements, and the ends of the support legs 27 which contact the fender or any portion thereof may be covered by a protective coating, such as rubber or vinyl. Furthermore, as best shown in FIG. 1, the ends of the support legs 27 are preferably sized so as to be securely captured and held in lip portions 32, 33 of fenders 34, 35 of the vehicle 14.

Figure 4:
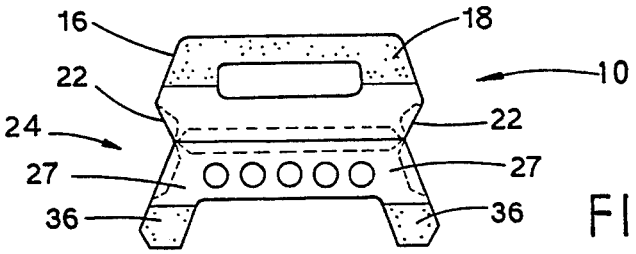
FIG. 4 is an end view of the work tray of FIG. 2.
Figure 5:
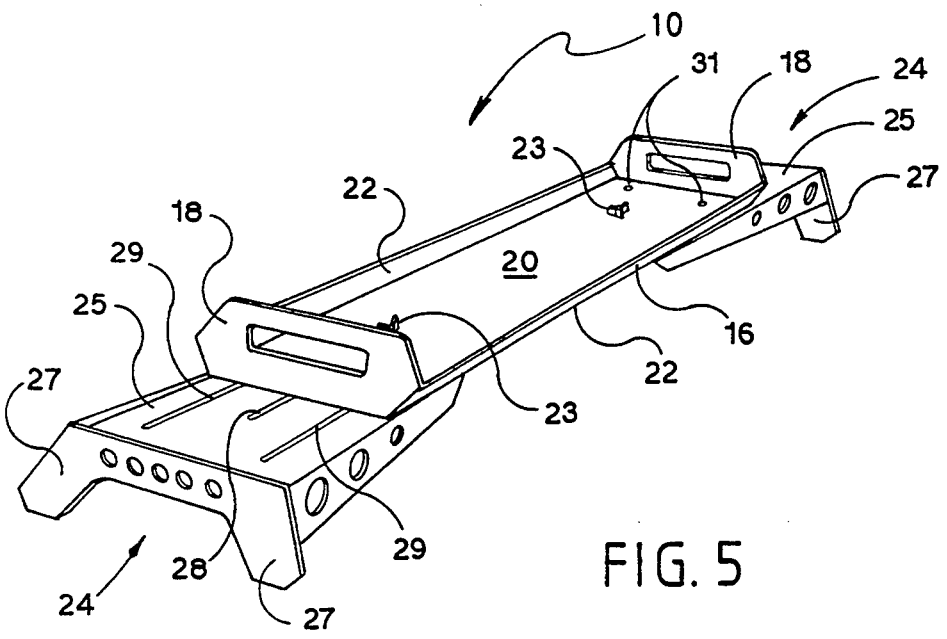
FIG. 5 is a perspective view of the work tray of FIG. 2, with the adjustable leg portions-in an extended position.

As shown in FIG. 4, the upper portions of the handles 18 may also be coated by the same or similar protective material, as the ends of support legs 27.

For illustrative purposes only, three elongated openings or slots 28, 29 are shown formed in the elongated upper portions of the leg means 24, in the figures of the drawings. More openings or slots could be added, if needed, or felt necessary for any reason. However, each of such openings or slots would also preferably slidably capture guiding and holding and/or securing means, such as 23, 31, in the openings 28, 29. Additionally, all such guiding and holding and securing means, such as 23 and 31, would have to be formed in or secured to the platform 20, and must pass through formed openings or slots in the elongated portion 25 of L-shaped leg means 24 in such a manner that the extensible leg-means 24 may be slidably adjusted with respect to the upper section 16, and fixed in any such position, as by loosening and then tightening the fixing means 23.

When a mechanic or other person is using the work tray of the present invention in a vehicle such as 14, each L-shaped leg means 24 is adjusted relative to the upper tray section 16, as by loosening the securing means 23 and extending (or if already extended, pushing in) the leg means 24, so as to allow the work tray 10 to bridge the engine compartment 12 and over any upstanding portion of the engine, such as an air cleaner 38, with the ends or bottoms of the support legs 27 preferably held in the lips 32, 33 or supported on the opposite fenders 34, 35. The leg means 24 are locked or secured in this position relative to the engine compartment, either before or after the work tray is placed in position, by tightening the securing means 23, in a known manner. Depending on the need of the mechanic or person using the tray, and the area of the engine compartment in which it is desired to work, the work tray 10 is left in position over the air cleaner, or moved along the fenders to the best, most desirable position for use by the mechanic when working under the hood in the engine compartment. After the work tray is no longer needed at the vehicle where it is being used, it may be emptied of tools, supplies and the like, and cleaned and stored, or may be moved to be used again, on a different size vehicle by merely transporting the tray by the handles 18, adjusting the leg means 24 to the required position out from or under the tray section 16, and placing the readjusted work tray over a further engine compartment.

In further embodiments of the work tray of the present invention, not shown, a hinged or other type of removable cover may be mounted over and supported on the upper tray section 16, and/or further devices may be added to or supported by this upper tray section.

Although the work tray of the present invention could be used to hold and store tools and other equipment or supplies in other circumstances or situations, it is the intent of the present invention to mount and use the work tray of the present invention to hold tools, equipment and supplies of a mechanic or the like, working in or around the engine compartment of a vehicle to provide ready and easy access to the supported items.

It, therefore, can be seen that the present invention provides a novel and improved adjustable, work tray which is simple to use, simple to manufacture, and which allows tools and supplies to be placed in a convenient position where they are readily and easily accessible while working around the engine compartment of various vehicles. In addition, since the leg means supporting the tray section are easily extensible from the tray section, the work tray may be easily used with various vehicles, or stored in a position not readily susceptible to use for storage of other trays or devices.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A mechanic's work tray for holding and supporting a plurality of items in a convenient location comprising, in combination:

a substantially rectangular upper section forming a holding tray having a substantially flat bottom surface and a plurality of substantially flat side walls connected to said bottom surface and extending away from said flat bottom surface a predetermined distance;

said substantially flat bottom surface including an underlying lower surface, and said substantially flat bottom surface and said plurality of substantially flat side walls, constructed in one piece from a material selected from the group of metals and plastics, which material has sufficient strength to prevent said substantially flat bottom surface from being bent when a plurality of items are held and supported therein;

at least one handle fixed to said substantially flat bottom surface for transporting said mechanic's work tray;

a pair of separate L-shaped leg means slidably held by a plurality of elongated openings formed therein to said underlying lower surface of said substantially flat bottom surface; and a plurality of guiding and securing means secured to said underlying lower surface of said substantially flat bottom surface and extending into said plurality of elongated openings formed in said L-shaped leg means to allow said L-shaped leg means to be adjustably guided and moved along said elongated openings, with respect to :said underlying lower surface of said substantially flat bottom surface.

2. The mechanic's holding tray for holding and supporting a plurality of items of claim 1 wherein there are a pair of adjustable securing means secured to said substantially flat bottom surface so as to extend through said underlying lower surface and into an elongated opening in each of said L-shaped leg means.

3. The mechanic's holding tray for holding and supporting a plurality of items of claim 2 wherein said at least one handle is coated with a protective material.

4. The mechanic's holding tray for holding and supporting a plurality of items of claim 1 wherein each of said pair of L-shaped leg means includes an elongated upper portion and a pair of support legs extending at 90 degrees to said elongated upper portion.

5. The mechanic's holding tray for holding and supporting a plurality of items of claim 4 wherein the elongated upper portions of said L-shaped leg means have three elongated openings formed therein,

6. The mechanic's holding tray for holding and supporting a plurality of items of claim 5 wherein two of said three elongated openings in said elongated upper portions of said L-shaped leg means have a pair of guide pin means held therein.

7. The mechanic's holding tray for holding and supporting a plurality of items of claim 6 wherein a third of said three elongated openings in said elongated upper portions of said L-shaped leg means has one of the adjustable securing means captured therein.

8. A mechanic's work tray for holding and supporting a plurality of items in a convenient location in a vehicle engine compartment comprising, in combination:

a substantially rectangular upper section forming a holding tray having a substantially flat bottom surface and a plurality of substantially flat side walls connected to said bottom surface and extending away from said substantially flat bottom surface to form at least one compartment on said substantially rectangular upper section;

said substantially flat bottom surface including an underlying lower surface, and together with said plurality of substantially flat side walls being constructed in one piece from a material selected from the group of metals and plastics, which material has sufficient strength to prevent said substantially flat bottom surface and said underlying lower surface from being bent when a plurality of items are held and supported in said substantially rectangular upper section;

a plurality of handles fixed to said substantially flat bottom surface for transporting said mechanic's work tray;

a pair of L-shaped leg means, each having an elongated upper portion with a plurality of elongated openings formed therein, and a pair of support legs extending at 90 degrees to said elongated upper portion;

said pair of L-shaped leg means adjustably held by said plurality of elongated openings in the elongated upper portions to said underlying lower surface of said substantially flat bottom surface; and a plurality of guiding and securing means, including a pair of guide pin means, secured between said underlying lower surface of said substantially flat bottom surface and said pair of L-shaped leg means and captured in said plurality of elongated openings to allow said L-shaped leg means to be adjustably guided and moved along said elongated openings, with respect to said underlying lower surface of said substantially flat bottom surface.

9. The mechanic's holding tray for holding and supporting a plurality of items of claim 8 wherein said plurality of handles are coated with a protective material.

10. The mechanic's holding tray for holding and supporting a plurality of items of claim 8 wherein said pair of support legs on each L-shaped leg means has its end coated with a protective material.

11. The mechanic,'s holding tray for holding and supporting a plurality of items of claim 8 wherein each of said elongated upper portions of said L-shaped leg means has three elongated openings formed therein.

12. The mechanic's holding tray for holding and supporting a plurality of items of claim 11 wherein one of said three elongated openings in each of said elongated upper portions of said L-shaped leg means captures and holds adjustable securing means fixed between said underlying lower surface of said substantially flat bottom surface and said L-shaped leg means.

13. The mechanic's holding tray for holding and supporting a plurality of items of claim 12 wherein two of said three elongated openings in said elongated upper portions of each of said L-shaped leg means have said pair of guide pin means secured therein.

14. A mechanic's work tray for holding and supporting a plurality of items in a convenient location over an engine compartment of a vehicle comprising, in combination:

a substantially rectangular upper section forming a holding tray having a plurality of substantially flat side walls connected to a substantially flat bottom surface and extending away from said substantially flat bottom surface a predetermined distance to form at least one compartment in said substantially rectangular upper section;

said substantially flat bottom surface having an upper surface within said at least one compartment and a parallel, underlying lower surface;

said substantially rectangular upper section being constructed in one piece from a material selected from the group of metals and plastics, which material has sufficient strength to prevent said substantially rectangular upper section from bending when a plurality of items are held and supported in said at least one compartment;

two of said substantially flat side walls forming end walls at opposite ends of said substantially flat bottom surface and having a pair of handles fixed to and forming a portion of said substantially rectangular upper section for transporting said mechanic's work tray;

a pair of L-shaped leg means, each of said pair of L-shaped leg means having an elongated upper portion with three elongated openings formed therein, and a pair of support legs extending at 90 degrees to said elongated upper portion;

each of said pair of L-shaped leg means being adjustably held by said three elongated openings in the elongated upper portions to said parallel, underlying lower surface of said substantially flat bottom surface; and three guiding and securing means, including a pair of guide pin means and an adjustable securing means, secured between said parallel, underlying lower surface of said substantially flat bottom surface of said substantially rectangular upper portion and each of said pair of L-shaped leg means; said pair of guide pin means captured in two of said three elongated openings formed in said elongated portion of each of said pair of L-shaped leg means, to allow each of said L-shaped leg means to be adjustably guided and moved along said two elongated openings in which they are captured, with respect to said underlying lower surface of said substantially flat lower surface; and a third of said elongated openings in each of said elongated upper portions of said pair of L-shaped leg means capturing and holding said adjustable securing means which is fixed between said parallel, underlying lower surface and each of said pair of L-shaped leg means.

* * * * *